US008790039B2

(12) United States Patent
Veyrieres

(10) Patent No.: US 8,790,039 B2
(45) Date of Patent: Jul. 29, 2014

(54) MODULAR FLOATING STRUCTURES WITH ANTI POLLUTION BARRIER

(75) Inventor: Philippe Veyrieres, Portbail (FR)

(73) Assignee: Cubisystem Sarl, Portbail (FR)

( * ) Notice: Subject to any disclaimer, the term of this patent is extended or adjusted under 35 U.S.C. 154(b) by 285 days.

(21) Appl. No.: 12/816,592

(22) Filed: Jun. 16, 2010

(65) Prior Publication Data

US 2011/0286798 A1 Nov. 24, 2011

(30) Foreign Application Priority Data

May 19, 2010 (FR) ..... 10 53892
May 19, 2010 (FR) ..... 10 53893

(51) Int. Cl.
*E02B 15/04* (2006.01)

(52) U.S. Cl.
USPC ..... 405/70; 405/224

(58) Field of Classification Search
USPC ..... 405/52, 60, 63, 66, 70, 224, 26, 219; 114/293, 294, 266, 264
See application file for complete search history.

(56) References Cited

U.S. PATENT DOCUMENTS 2,693,161 A * 11/1954 Stubbs ..... 405/71
3,641,770 A * 2/1972 Fitzgerald ..... 405/67
3,763,808 A 10/1973 Smith, Sr.
3,800,542 A * 4/1974 Cerasari ..... 405/72
3,824,644 A * 7/1974 Stranzinger ..... 14/27
3,921,407 A * 11/1975 Neal ..... 405/63
4,013,042 A * 3/1977 Ingold ..... 119/223
4,086,874 A * 5/1978 Sterner ..... 119/223
4,342,277 A * 8/1982 Sluys ..... 114/293
4,604,962 A * 8/1986 Guibault ..... 114/266
4,750,445 A * 6/1988 Awalt, Jr. ..... 114/200
5,183,001 A * 2/1993 Stranzinger ..... 114/266
5,333,423 A * 8/1994 Propst ..... 52/126.6
5,511,906 A 4/1996 Oberg
5,711,634 A 1/1998 Oberg
5,931,113 A 8/1999 Eva, III et al.
5,984,577 A 11/1999 Strong
6,431,106 B1 * 8/2002 Eva et al. ..... 114/263
6,609,853 B1 8/2003 Guilmette (Continued)

FOREIGN PATENT DOCUMENTS

DE 975604 C 2/1962
EP 1721824 A2 11/2006

(Continued)

OTHER PUBLICATIONS

French Search Report, dated Jan. 20, 2011, from corresponding French Patent Application 1053892.
International Search Report, dated Oct. 19, 2011, from corresponding International Patent Application PCT/FR2011/051058.

*Primary Examiner* — Thomas B Will
*Assistant Examiner* — Jessica H Lutz
(74) *Attorney, Agent, or Firm* — Young Basile

(57) ABSTRACT

A floating structure comprising floating, modular, parallelepipedic blocks whose vertical edges are provided with lugs in which connecting elements are inserted in order to assemble the blocks. The connecting elements entail a support key, which at its upper part bears stanchion extending above upper surface of the floating structure, the stanchion being provided with an eyelet capable of constituting a point of attachment for net. One or more anchoring points are situated below and to the interior of the floating structure. Also disclosed are applications of the floating structures, including as anti-pollution barriers.

8 Claims, 5 Drawing Sheets

(56) References Cited

U.S. PATENT DOCUMENTS

| | | | | |
|---|---|---|---|---|
| 6,739,801 | B2 | 5/2004 | Dreyer | |
| 6,743,367 | B2 | 6/2004 | Dreyer | |
| 6,827,618 | B1 * | 12/2004 | Hampton et al. | 441/80 |
| 6,843,027 | B2 * | 1/2005 | Gaddie et al. | 52/92.1 |
| 7,401,565 | B2 * | 7/2008 | Nixon et al. | 114/241 |
| 7,461,611 | B2 * | 12/2008 | Hebden et al. | 114/263 |
| RE40,616 | E * | 1/2009 | Nixon et al. | 114/241 |
| 7,540,070 | B1 * | 6/2009 | Selby | 24/265 H |
| 7,712,195 | B1 * | 5/2010 | Selby | 24/265 R |
| 7,731,452 | B2 * | 6/2010 | Yodock et al. | 405/72 |
| 8,037,837 | B2 * | 10/2011 | La Violette et al. | 114/263 |
| 2005/0058509 | A1 * | 3/2005 | Steinberg | 405/34 |
| 2008/0105184 | A1 | 5/2008 | Nixon et al. | |
| 2009/0035068 | A1 * | 2/2009 | Terai et al. | 405/211 |

FOREIGN PATENT DOCUMENTS

| | | | | | |
|---|---|---|---|---|---|
| EP | 2138393 | A1 | | 12/2009 | |
| FR | 64079 | E | | 10/1955 | |
| FR | 2699495 | A1 | | 6/1994 | |
| FR | 2699496 | A1 | | 6/1994 | |
| FR | EP0604313 | | * | 6/1994 | B63B 35/38 |
| FR | EP1880938 | | * | 1/2008 | B63B 21/00 |
| JP | H1123995 | U | | 8/1989 | |
| JP | 9183399 | A | | 7/1997 | |
| JP | 2002180433 | A | * | 6/2002 | E02B 1/00 |
| WO | 8300890 | A1 | | 3/1983 | |
| WO | 2006075831 | A1 | | 7/2006 | |

* cited by examiner

MODULAR FLOATING STRUCTURES WITH ANTI POLLUTION BARRIER

CROSS REFERENCE TO RELATED APPLICATIONS

This application claims priority to French patent application Serial Number 1053892 filed on May 19, 2010 and to French patent application Serial Number 1053893 filed on May 19, 2010, both incorporated by reference herein in their entirety.

FIELD OF THE INVENTION

The embodiments herein relate in general to the domain of modular floating blocks intended for forming floating structures and the use of the structures for spill containment.

BACKGROUND

Many conventional modular blocks assembled for use in water all pose problems of sea state capability when the sea is choppy, particularly when these structures are not placed in the shelter of a harbor. Many of these structures consist of modular floating blocks with the anchoring or securing of the structures brought about by horizontal bars provided with lugs which cooperate with the lugs of the blocks in such a way that they are run through by keys, these bars being arranged on the side of said structures. This method of securing the floating structures thus executed does not prove satisfactory with use.

SUMMARY

According to a first embodiment, a floating structure can comprise floating, modular, parallelepipedic blocks each having vertical edges configured with lugs in which connecting elements are inserted to assemble the blocks. The connecting elements can comprise a support key, a stanchion born by an upper part of the support key, the stanchion extending above an upper surface of the floating structure and eyelets provided in the stanchion configured for attachment to a net.

The embodiments disclosed herein can have one or more of the following characteristics. Each anchoring point can consist of an anchoring key which has a rod engaged in the lugs of several adjacent blocks in order to assemble said blocks, said rod having means for securing a rope extending below the floating structure from the lower end of the rod. The rod can have a bore which receives the rope which is secured at one of its ends to said rod by a stop component. The other end of the rope is secured to an anchoring line connected to a mooring or to an anchor.

The floating structure can have a buoy arranged between the rope and the anchoring line. The stop component can entail a stop rod which rests on a washer, said washer resting on one of the lugs of a block. The stop component is arranged essentially horizontally. The rod of the anchoring key can be arranged essentially vertically. The anchoring key has a conical upper part on top of the rod, said conical part being engaged in a conical housing, said conical housing being formed, at the interface of four assembled blocks, by a chamfered corner of each of said assembled blocks. Each block can be provided with a lug at each of its four edges, said lugs being placed at different levels and in each case having a bore capable of receiving the rod of the anchoring key.

A second embodiment disclosed herein of a floating structure comprises floating, modular, parallelepipedic blocks whose vertical edges are provided with lugs in which connecting elements are inserted in order to assemble said blocks, is characterized by the fact that the connecting elements entail a support key, which at its upper part bears a stanchion extending above an upper surface of the floating structure, said stanchion being provided with an eyelet capable of constituting a point of attachment for a net.

In the second embodiment, for example, the modification of the connecting keys so that they can have, besides their connecting function, a support function for various devices such as railings, aquaculture nets or nets for maintaining gas oil slicks is disclosed.

Embodiments disclosed herein can moreover have one or more of the following characteristics. The support key can have a cylindrical lower part which is inserted in the lugs of several adjacent blocks, said cylindrical lower part being provided with immobilizing means for immobilizing the support key in terms of rotation with respect to said lugs, and has a conical upper part which is engaged in a conical housing formed, at the interface of the adjacent blocks, by a chamfered corner of each of said adjacent blocks. The cylindrical lower part of the support key can have a threaded end portion capable of receiving a nut for firmly securing the support key in the lugs of the blocks.

At least one spacer can engage on the cylindrical lower part of the support key in a position selected from the group consisting of a lower position between the nut and a lug, an intermediate position between two lugs and an upper position between a lug and the conical upper part. A block can be provided with a lug at each of its four edges, said lugs being placed at different levels and in each case having a bore capable of receiving the cylindrical lower part of the support key. A number of support keys can be arranged along an edge of the floating structure, the stanchions of said support keys bearing a net which is secured to the eyelets, said net extending below a lower surface of the blocks and being weighted at the site of its lower edge.

The stanchions maintain an upper portion of the net above the upper surface of the blocks. The stanchion of the support key can be provided with a number of eyelets arranged at regular intervals along its height. An anchoring point of the floating structure can be situated below and to the interior of said structure, said anchoring point being connected by a rope to a fixed point, preferably by the intermediary of a float.

The embodiments disclosed herein provide modular floating structure with stability when used in choppy seas. The embodiments disclosed herein can be used as anti-pollution boom on a water surface. According to some embodiments, the characteristics of the first and second embodiments can be further combined.

BRIEF DESCRIPTION OF THE DRAWINGS

The invention will be better understood and other aims, details, characteristics and advantages of it will appear more clearly in the course of the following description of several particular embodiments which are given on a solely illustrative and non-limiting basis in reference to the appended drawings. The description herein makes reference to the accompanying drawings wherein like reference numerals refer to like parts throughout the several views, and wherein.

DETAILED DESCRIPTION

These blocks, consisting of parallelepipedic structures with square or rectangular bases, are generally made of hollow synthetic material and are assembled in such a way as to form a surface allowing the circulation of persons or equipment. These structures have multiple applications such as floating docks, aquaculture basins, leisure surfaces or the possibility of doing work on water surfaces. Because of their modular structure, it is possible to create multiple geometric forms according to the nature of their use. These applications are provided by means of example and are not meant to be limiting.

Figure 1:
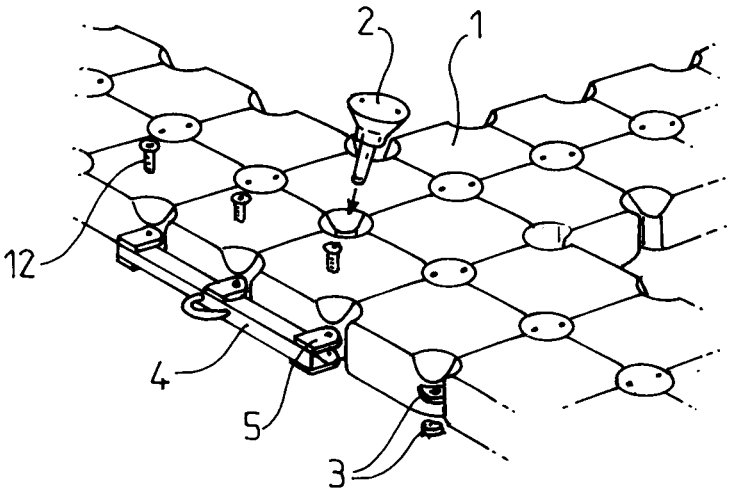
FIG.1 PRIOR ART
FIG. 1 represents a floating structure secured by means of lateral bars as known in the art.

In FIG. 1, it is seen that the floating structure consists of blocks 1, which are modular, floating, parallelepipedic, whose vertical edges are provided with lugs 3 in which connecting keys 2 are inserted, ensuring that they are assembled together. The securing of such assemblies to a fixed point, for example, a mooring post, pier or anchor, is ensured by bars such as bar 4 which is provided with lugs 5 which cooperate with lugs 3 of blocks 1 situated on the edges of the structure, in such a way that they are run through by fastening pins 12. The floating structure is therefore secured on its sides to a fixed point such as a pier, a ship or an anchor. This lateral securing method has the drawback that when the sea is very choppy, the edges of the structure dip in and water runs over it, which is detrimental to its strength.

Figure 2:
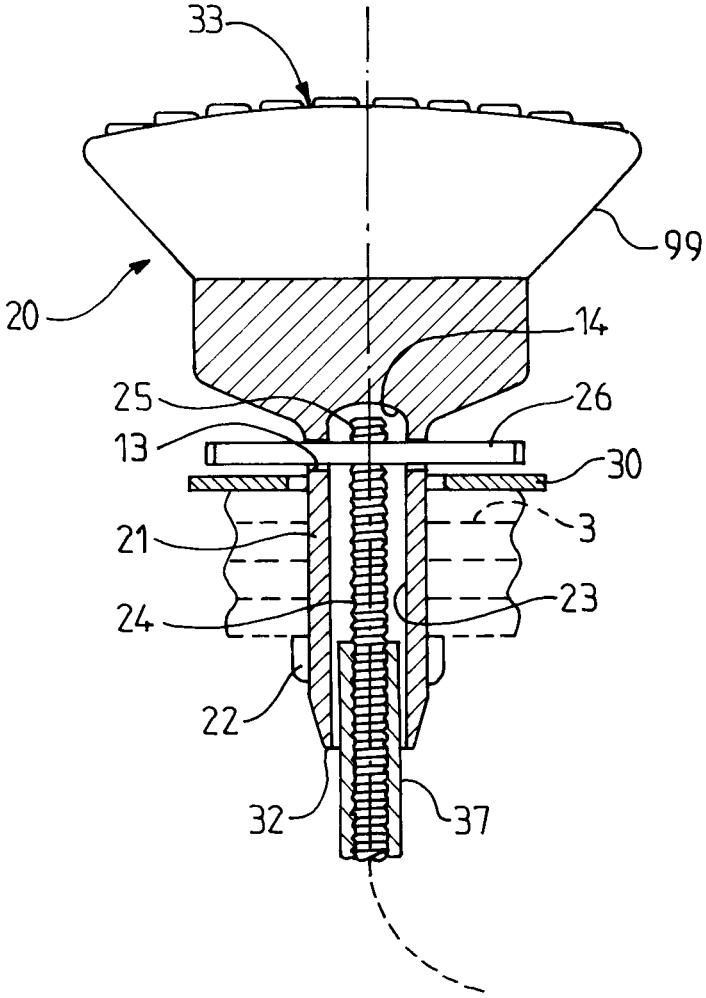
FIG. 2 represents a connecting key forming an anchoring means, which can be used in a floating structure.
Figure 3:
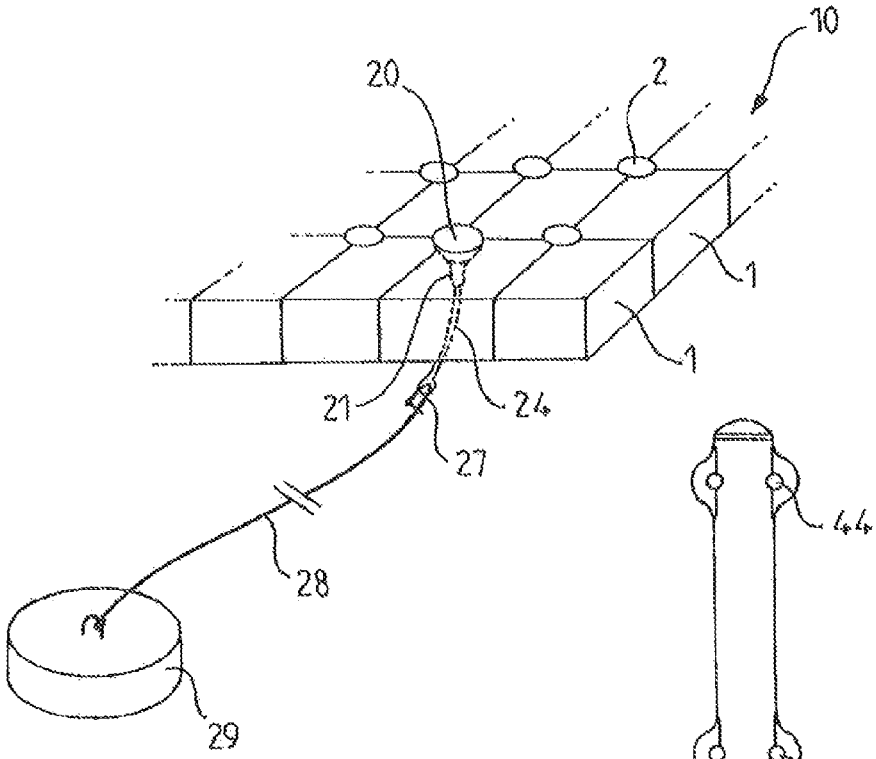
FIG. 3 diagrammatically illustrates a floating structure anchored by the key of FIG. 2.

In order to remedy this serious drawback, proposed in an embodiment represented in FIGS. 2 and 3 is the securing of the floating structure by arranging anchoring points to the interior of and below said structure. This can be done without modifying its assembling system. Used for this purpose are one or more connecting keys modified for providing anchoring points as represented in FIG. 2.

In reference to this figure, one sees anchoring key 20 which has the same shape as connecting key 2, its rod 21 having the same stubs 22 or grooves as those described in patent FR2669495, which cooperate with lugs 3 in order to ensure the assembly of blocks 1; but rod 21 of this anchoring key 20 is hollowed with bore 23 open at its lower end 32 on the opposite side from surface 33, which is flush with the upper surface of blocks 1.

Introduced into bore 23 of rod 21 is rope 24, preferably made of synthetic textile material, whose end loop 25 is run through by stop rod 26, preferably made of stainless steel, passing through two openings 13 hollowed transversely through rod 21 near bottom 14 of bore 23. Rope 24 can be surrounded by plastic sheath 37 in order to increase its durability and to protect it from mechanical aggressions.

At its other end, rope 24 is attached by shackle 27 to mooring line 28, which can be a chain, which is attached to mooring 29 or to an anchor (FIG. 3).

It is seen in FIG. 3 that stop rod 26 arranged across bore 23 and rope 24 provide structure 10, formed by the assembly of blocks 1, with a mooring point arranged to the interior of and below said structure 10.

This arrangement obtains numerous advantages. It makes it possible to place the anchoring point to the interior of and below the floating structure without modifying the capability of the system, since anchoring key 20 has the same securing role as connecting keys 2. The anchoring works on four lugs 3 and not only two as in the earlier arrangement, which is a great advantage in heavy weather.

Securing bars 4 of FIG. 1, placed on the periphery of the floating structure, when they are tied to a fixed point in heavy weather, or because of the current, have the effect of making the edge of the structure dip into the water, which offers a resistance to the flow of the waves and water. In contrast, with the arrangement of FIG. 3, the traction exerted under floating structure 10 makes the edges of blocks 1, situated on the opposite side from the anchoring point, to rise, which facilitates the passage of waves and the flow of water, while preventing the water from running over the floating structure.

Furthermore, the metallic parts such as shackles 27 are continually immersed, whereas bar 4 and lugs 5 are sometimes in the air and sometimes in the water, which accelerates their oxidation.

In reference to FIG. 2, it is seen that stop rod 26 works by vertically resting on washer 30, which itself rests on lugs 3 of block 1: consequently, traction is no longer applied to these lugs 3 as in the known device of FIG. 1. In FIG. 2, sketched in the form of broken lines is the superposition of four lugs 3 belonging to four blocks 1 whose anchoring key 20 ensures the assembly at the site of their adjacent corners.

Quite obviously, it is possible to arrange one or more points of anchoring by means of one or more anchoring keys 20. The rest of structure 10 can be assembled by means of connecting keys 2 and/or support keys 50 which will be described below.

This new anchoring method, which has the advantage of preventing the floating structure from plunging in the waves in heavy weather, enables it to be used effectively for uses such as aquaculture or for forming floating booms, and in particular floating booms for containing an oil spill.

Figure 4:
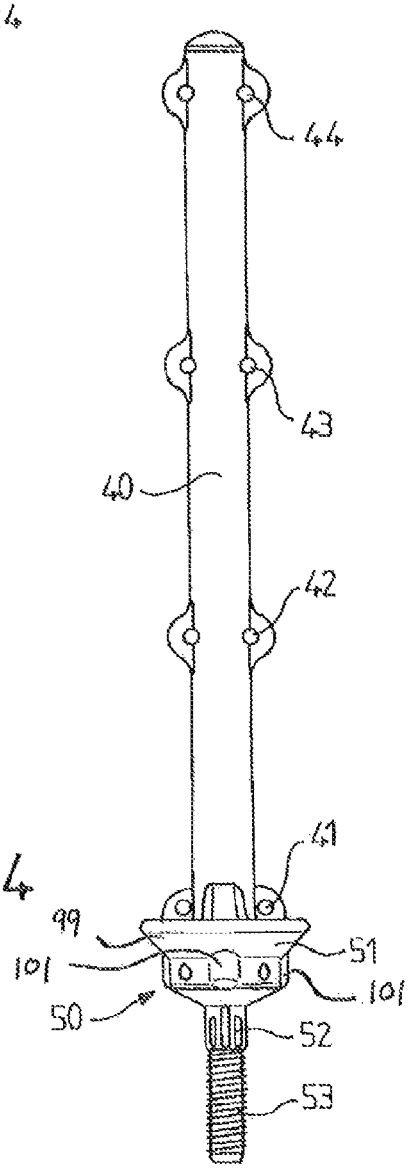
FIG. 4 represents a support key bearing a stanchion which can be used in a floating structure.

FIG. 4 represents stanchion 40, borne by support key 50, fulfilling the same function of connecting the parallelepipedic blocks 1 as connecting key 2 of FIG. 1 and anchoring key 20 of FIG. 2, and having a similar shape. Support key 50 can be produced in the form of a single piece with stanchion 40, for example, out of high density polyethylene that is resistant to ultraviolet radiation and to hydrocarbons. A bright color can be used for improving visibility and safety, for example, a bright yellow.

Support key 50 has conical upper part 99 which is engaged in the conical housing formed by the assembly of four blocks, in the manner of conical part 51 of anchoring key 20. Support key 50 also has cylindrical lower part 52 and 53, part 52 having means for immobilization in terms of rotation,e.g. protrusions 101, and part 53 being threaded for receiving nut 98, which can be seen in FIG. 7.

Stanchion 40 has eyelets 41 to 44 at regular intervals, which are points of attachment for various devices, such as a net, for example.

Figure 5:
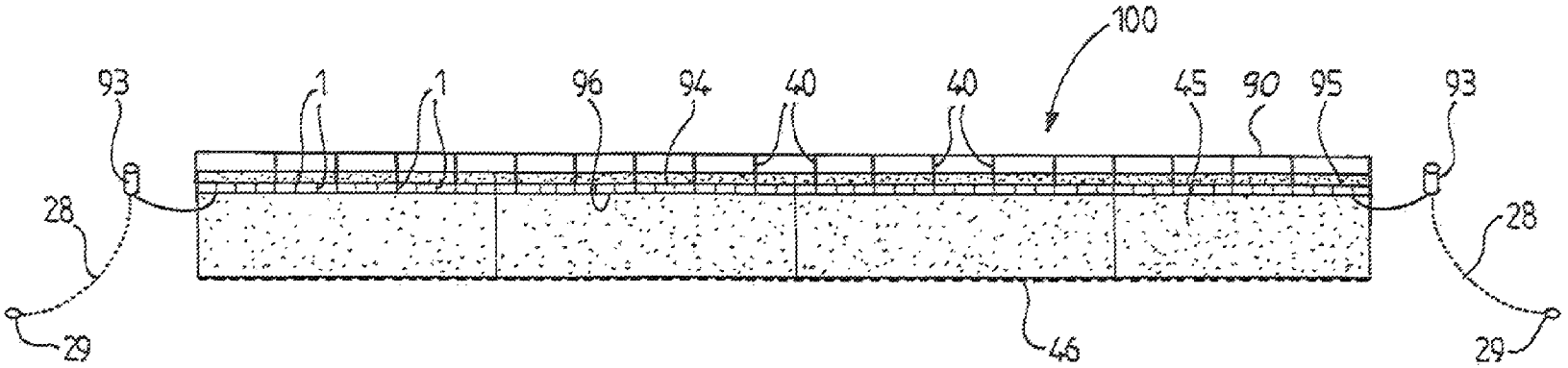
FIG. 5 is a lateral elevation of a structure according to one embodiment of the invention, provided with stanchions according to FIG. 4 bearing a net, which can be used as an anti-pollution boom.
Figure 6:
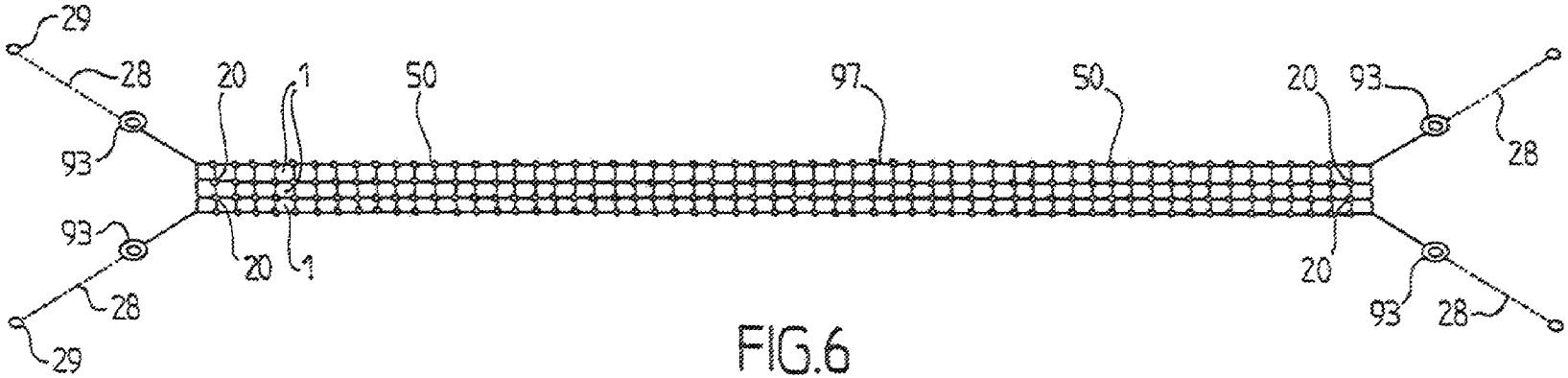
FIG. 6 is a top view of the structure of FIG. 5.

FIG. 5 represents floating structure 100 made of an assembly of floating blocks such as blocks 1 of FIGS. 1 and 3. As seen in FIG. 6, these blocks 1 are aligned three by three so as to produce a structure in the lengthwise direction. Arranged on this floating structure 100 in the lengthwise direction are stanchions 40, each borne by a key such as support key 50 of FIG. 4.

Net 45 is secured to these stanchions. Because of the existence of eyelets 41, 42, 43 and 44, this net can be secured at different heights. Weighted rope 46 maintains net 45 immersed in an essentially vertical position. For an anti-pollution boom, stanchions can be arranged as desired: on all the blocks, on every other block or every three blocks or at any desired interval.

Since there are eyelets 41, 42 etc., at several levels, it is possible to adapt the height of net 45 as a function of the sea conditions and of the pollutant in order to prevent passage of this pollutant over floating structure 100. It is thus possible to adjust the extent of upper part 95 of net 45 which rises above surface 94 of blocks 1, and consequently the extent of the lower part of said net 45 which plunges below lower surface 96 of said blocks 1.

These stanchions 40 also make it easy to raise net 45 in order to put it in non-operational position, for example, folded on surface 94, so as to preserve the ecosystem when possible, for example, during shifting and positioning of the anti-pollution boom.

One has the choice of arranging stanchions 40 along edge 97 of floating structure 10 or to the interior of this structure between two rows of blocks 1, or in any other desired position, particularly at the site of an exterior corner of floating structure 100. This last possibility is illustrated in FIGS. 7 to 10.

The fact that blocks 1 have no sharp angles prevents tearing of net 45. Implementation is easy because it is easy for the personnel to walk and move about on the floating structure; in order to improve safety, handrail 90 can be secured on the highest eyelets 44.

The advantages of this arrangement are numerous: net 45 is secured by rope end or snap hooks which is very easy; the meshwork of the net can be adapted to the type of pollutant; the height of the net can be adapted to the sea conditions; the weight of rope 46 can be adapted to the conditions of the site; the depth to which the net dives can be adapted; the length and shape of floating structure 100 can be adapted as desired.

As represented in FIGS. 5 and 6, buoy 93 can be added to anchoring lines 28, thus dampening the variations of the tension on lines 28 when the sea is choppy.

Figure 7:
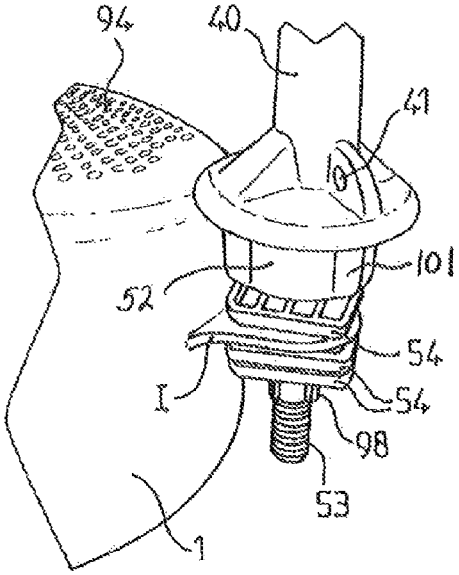
FIGS. 7 to 10 are four perspective views representing the four lugs of a block which can be used for producing floating structures, lugs which are arranged at four different levels.

FIGS. 7 to 10 are four perspective views of lugs I, II, III and IV arranged at different levels. FIG. 7 represents lug I. As seen, this lug I is arranged on a vertical edge of block 1, this edge being rounded, and it is placed approximately at mid-height of this edge. Rod 52, 53 of support key 50 passes through the opening of lug I and is held in position by spacers 54: one spacer 54 above lug I and two spacers 54 below it.

Figure 8:
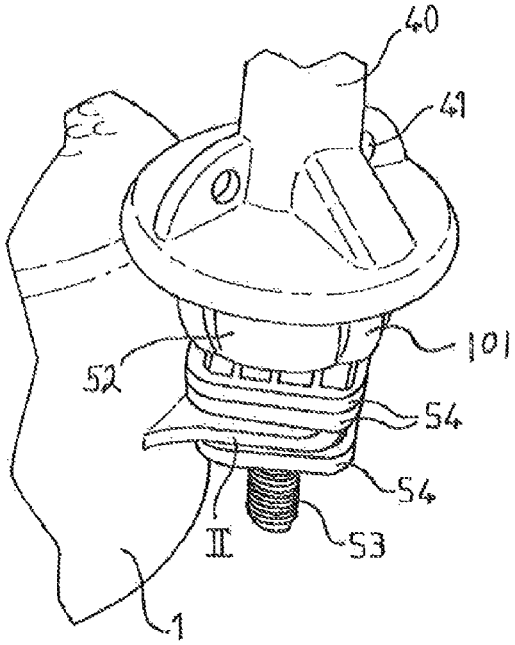

FIG. 8 represents lug II. It is arranged on another edge of block 1, at a slightly lower height than that of lug I. Rod 52/53 passing through this lug II is held in position by spacers 54: two spacers 54 above and one below.

Figure 9:
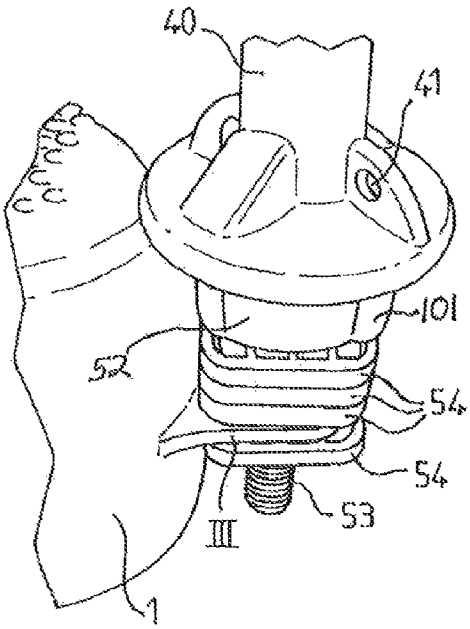

FIG. 9 represents lug III. It is arranged on a third edge of block 1, at a slightly lower level than that of lug II. In order to maintain rod 52/53, there are four spacers 54, three above and one below.

Figure 10:
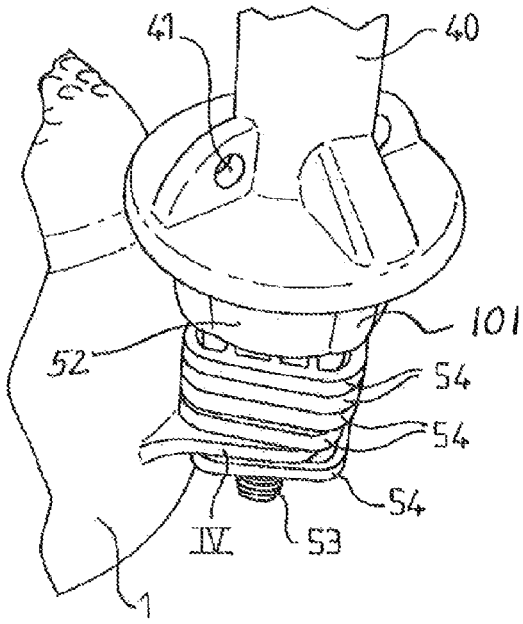

FIG. 10 represents lug IV. It is arranged on the fourth edge of block 1, at a slightly lower level that that of lug III. In order to maintain rod 52/53, there are five spacers 54, four above and one below.

Figure 11:
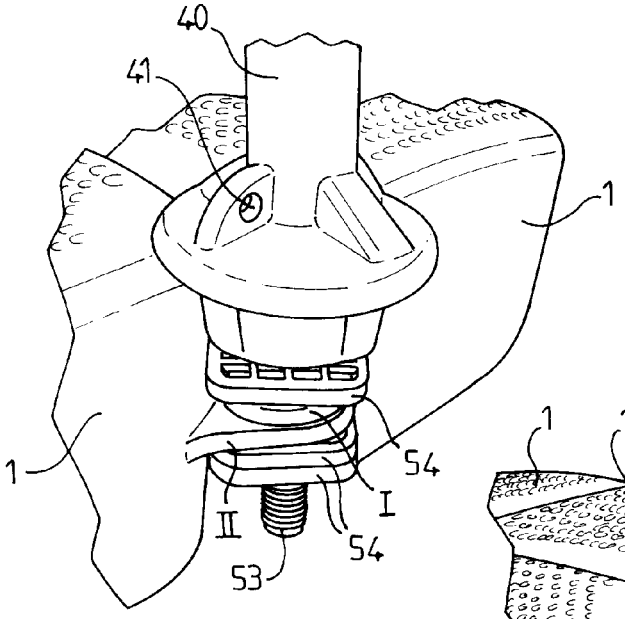
FIG. 11 illustrates the assembly of the support key of FIG. 4 with lugs I and II.
Figure 12:
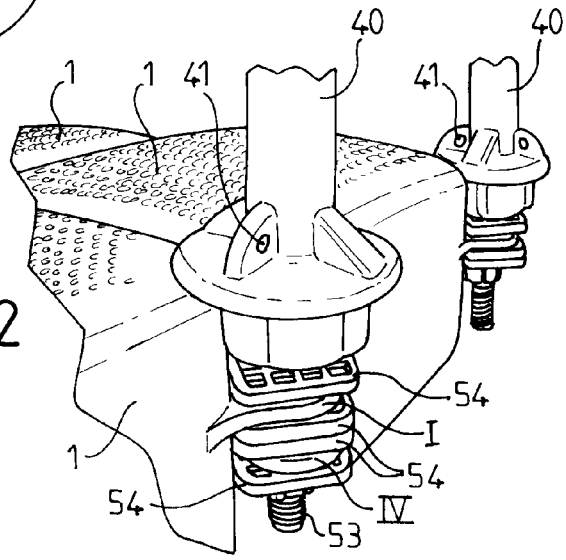
FIG. 12 illustrates the assembly with lugs I and IV.
Figure 13:
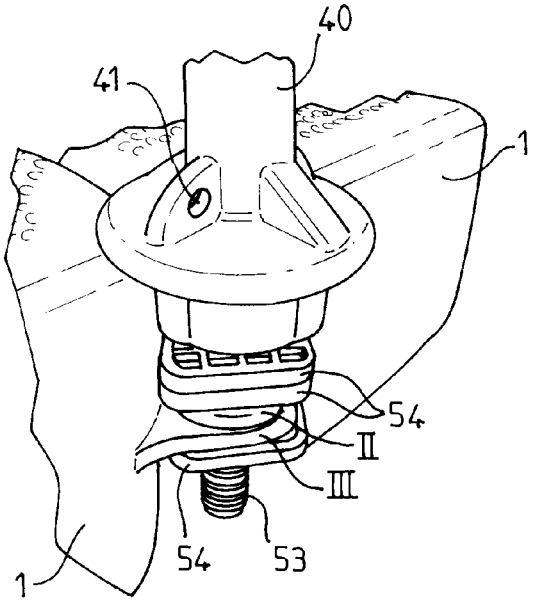
FIG. 13 illustrates the assembly with lugs II and III.
Figure 14:
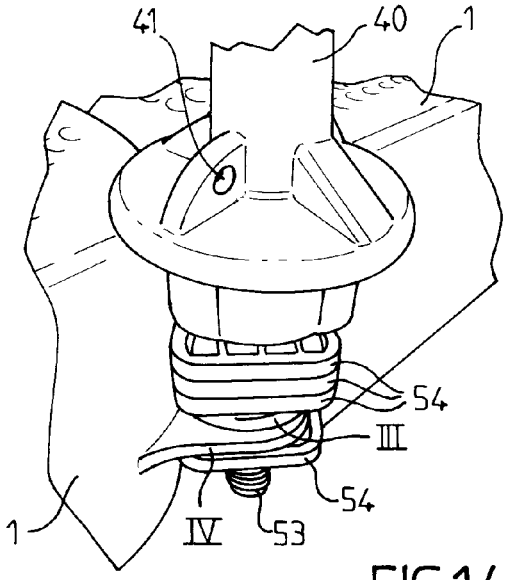
FIG. 14 illustrates the assembly with lugs III and IV.

FIG. 11 represents the assembly of two blocks 1 by means of support key 50 passing through lugs I and II. FIG. 12 represents the assembly of two blocks by means of support key 50 passing through lugs I and IV. FIG. 13 represents the assembly of two blocks 1 by means of support key 50 passing through lugs II and III. FIG. 14 represents the assembly of two blocks by means of support key 50 passing through lugs III and IV.

In all of FIGS. 7 to 14, spacers 54 are squeezed between and on both sides of lugs I, II, III, IV by tightening of nut 98 on threaded part 53 of the rod, making it possible to firmly secure support keys 50 to floating structure 100.

Although the invention has been described in connection with several particular embodiments, it is quite obvious that it is in no way limited to them and that it includes all technical equivalents of the means described as well as their combinations if they are included in the scope of the invention. In particular, connecting keys 2, anchoring keys 20 and support keys 50 can be used together in all possible combinations in order to produce a floating structure combining the advantage of stability obtained by anchoring keys 20 and the functionality of support keys 50, particularly in order to produce an anti-pollution boom. These keys 2, 20 and 50 can also be used independently of one another.

The use of the verbs "entail," "comprise" or "include" and their conjugated forms do not exclude the presence of elements or steps other than those set forth in a claim. The use of the indefinite article "a" for an element does not exclude the presence of a number of such elements unless otherwise specified.

While the invention has been described in connection with certain embodiments, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A floating structure comprising:

floating, modular, parallelepipedic blocks having vertical edges with lugs;

connecting elements inserted into the lugs to assemble the blocks; and wherein one or more of the connecting elements each comprise an anchoring key providing an anchoring point, the anchoring key comprising:

an upper part with an upper surface flush with upper surfaces of the blocks;

a rod engaged in the lugs of several adjacent blocks in order to assemble the blocks, the rod extending from a lower surface of the upper part and having a bore extending in a longitudinal direction of the rod for receiving and securing one end of a rope such that the rope extends through the bore and out an end of the rod opposite the upper part and below the floating structure, the bore being a blind bore which is closed where the rod meets the upper part of the anchoring key and comprising an upper portion which extends above the lugs;

wherein the one end of the rope is secured inside the bore by a stop component comprising a stop rod extending perpendicularly to the longitudinal direction of the rod and passing through the upper portion of the bore and through two openings hollowed transversely through the rod; and wherein the stop rod rests on a washer which rests on one of the lugs of the blocks.

2. The floating structure of claim 1, wherein another end of the rope is secured to an anchoring line connected to a mooring or to an anchor.

3. The floating structure of claim 2 further comprising a buoy arranged between the rope and the anchoring line.

4. The floating structure of claim 1, wherein the stop component is arranged essentially horizontally.

5. The floating structure of claim 1, wherein the rod of the anchoring key is arranged essentially vertically.

6. The floating structure of claim 1, wherein the anchoring key has a conical upper part on top of the rod, the conical upper part engaged in a conical housing formed at an interface of four assembled blocks by a chamfered corner of each of the assembled blocks.

7. The floating structure of claim 1, wherein the lugs at the vertical edges of each block are placed at different levels, each lug having a bore capable of receiving the rod of the anchoring key.

8. The floating structure of claim 1, wherein one or more of the connecting elements comprises an upper part with a top surface and a stanchion extending from the top surface configured to attach to a net.

* * * * *